US008350475B2

(12) United States Patent
Daub et al.

(10) Patent No.: US 8,350,475 B2
(45) Date of Patent: Jan. 8, 2013

(54) HIGH-PRESSURE GAS DISCHARGE LAMP FOR A LIGHTING DEVICE

(75) Inventors: Wolfgang Daub, Anrochte (DE); Michael Eusterbrock, Rietberg (DE); Gideon Kanne, Geseke (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 246 days.

(21) Appl. No.: 12/992,098

(22) PCT Filed: May 8, 2009

(86) PCT No.: PCT/IB2009/051895

§ 371 (c)(1), (2), (4) Date: Nov. 11, 2010

(87) PCT Pub. No.: WO2009/138926

PCT Pub. Date: Nov. 19, 2009

(65) Prior Publication Data

US 2011/0084605 A1 Apr. 14, 2011

(30) Foreign Application Priority Data

May 15, 2008 (EP) ..... 08156264

(51) Int. Cl.
*H01J 61/36* (2006.01)

(52) U.S. Cl. ..... 313/624; 313/625

(58) Field of Classification Search ..... 313/623–625, 313/634–636, 493, 318.12, 570, 578; 118/50; 445/26, 27

See application file for complete search history.

(56) References Cited

U.S. PATENT DOCUMENTS 7,042,169 B2 5/2006 Neumeier et al.

FOREIGN PATENT DOCUMENTS

| | | | |
|---|---|---|---|
| DE | 19913942 | C1 | 4/2000 |
| DE | 102005021728 | A1 | 11/2006 |
| JP | 2003317535 | A | 11/2003 |

*Primary Examiner* — Anh Mai
*Assistant Examiner* — Elmito Breval

(57) ABSTRACT

The invention relates to a high-pressure gas discharge lamp (8) for a lighting device, in particular for a headlight unit of a motor vehicle, with an electronic ignition system (9) that is arranged inside a lamp cap housing (1, 2) that comprises an upper part (1) and a cover (2), wherein said upper part (1) is provided with an opening (1.1) within which a high-voltage connection (4) between the high-pressure gas discharge lamp (8) and the electronic ignition system (9) is present, the cover (2) projects into said opening (1.1) and closes off this opening (1.1) in an insulating manner, and the mutually facing surfaces of the upper part (1) and the cover (2) form a labyrinth (3) that is interrupted by an insulating element (5).

15 Claims, 3 Drawing Sheets

HIGH-PRESSURE GAS DISCHARGE LAMP FOR A LIGHTING DEVICE

Figure 1:
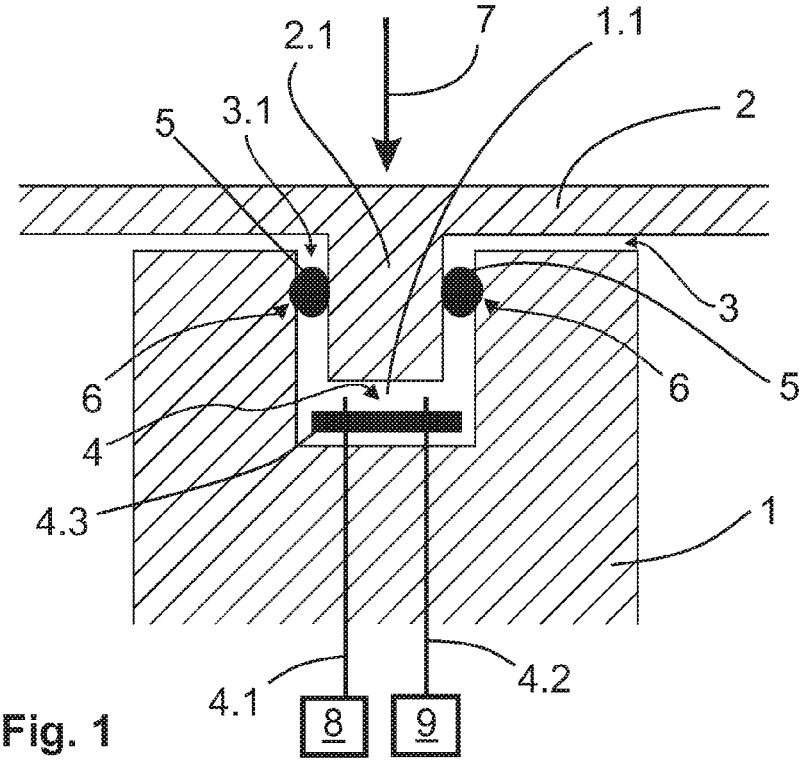

The invention relates to a high-pressure gas discharge lamp for a lighting device, in particular for a headlight unit of a motor vehicle, with an electronic ignition system that is arranged inside a lamp cap housing, the latter comprising an upper part and a cover.

U.S. Pat. No. 7,042,169 B2 discloses a lamp cap housing for a high-pressure gas discharge lamp that consists of a cover and an upper part. It may be necessary for the mounting of a high-pressure gas discharge lamp that contacts carrying a high voltage are arranged in an accessible manner inside the lamp cap's housing of the electronic ignition system. This region can be closed by means of the cover so as to be protected against high voltages. Both the wall thickness and the creepage path between the high-voltage contact and the outer world, however, must be sufficiently dimensioned to achieve that there is no high-voltage breakdown.

It is an object of the present invention to provide a high-pressure gas discharge lamp for a lighting device that is of a compact construction while the contacts that carry a high voltage are reliably insulated.

This object is achieved by the total of the characterizing features of claim 1. Advantageous further embodiments of the invention are indicated in the dependent claims.

It is for this purpose provided that a high-pressure gas discharge lamp for a lighting device, in particular for a headlight unit of a motor vehicle, cooperates with an electronic ignition system that is arranged inside a lamp cap housing, that said lamp cap housing comprises an upper part and a cover, said upper part being provided with an opening within which a high-voltage connection between the high-pressure gas discharge lamp and the electronic ignition system is present, that the cover projects into said opening and closes off this opening in an insulating manner, and that the mutually facing surfaces of the upper part and the cover form a labyrinth that is interrupted by an insulating element. The insulating element renders it possible on the one hand to make the labyrinth shorter and on the other hand to improve the insulation of the high-voltage connection between the cover and the upper part. This results in a space-saving construction of the high-pressure gas discharge lamp.

It is provided according to the invention that the insulating element forms a circumferentially closed ring. It is advantageous in that case if the basic shape of the circumferentially closed ring is circular, oval, or rectangular. The shape of the insulating element is dependent on the circumference of the labyrinth. It is particularly advantageous in this respect if the insulating element is constructed so as to have at least one of the following diametrical shapes: round, oval, or polygonal. The diametrical shape of the insulating element is dependent on the contour of the region that is to be sealed off and/or the positioning thereof inside the labyrinth.

Advantageously, the insulating element is constructed as an elastic sealing ring. It was found to be particularly advantageous when the sealing ring is made from an elastic polymer. The sealing ring made of an elastic polymer is capable of adapting its shape inside the labyrinth through deformation of its contact surface and thus form a protection screen that is resistant to high voltages.

The insulating element may be provided against the upper part and/or against the cover. It was found to be advantageous in this respect when the insulating element is directly injection-molded against the upper part and/or the cover. A reliable fixation of the insulating element inside the labyrinth can be safeguarded by the injection-molding of the insulating element, while at the same time the ease of assembling is enhanced. Alternatively, gluing of the insulating element would also be feasible.

In a further embodiment of the invention, the upper part and/or the cover is/are provided with a groove inside the labyrinth, in which groove the insulating element is detachably fastened. The geometry of the groove is such here that the insulating element is held in the groove by means of matching shapes.

In a further preferred embodiment, the contour of the insulating element has a lamellae shape. A lamellated construction of the insulating element causes a force to act inside the labyrinth in an end position of the cover and the upper part, retaining the cover on the upper part. The insulating element may be formed by one as well as by several lamellae. It is particularly advantageous when the insulating element exerts a force both on the cover and on the upper part inside the labyrinth. This insulating measure leads to an improvement of the screening inside the labyrinth. Furthermore, the insulating element may have a diameter in cross-section of $0.5\ \text{mm} \leqq x \leqq 4\ \text{mm}$. The diameter of the insulating element may be dependent both on the elasticity of the insulating element and on the diameter of the labyrinth.

A further measure according to the invention provides that at least two insulating elements are arranged inside the labyrinth. The arrangement of at least two insulating elements inside the labyrinth enhances the screening effect for a given labyrinth length. Especially high-pressure gas discharge lamps with two or three insulating elements were found to constitute a particularly good compromise between the number, cost, and effectiveness of the insulating elements.

The insulating elements are advantageously interconnected. A connection of the materials themselves, in particular through gluing and/or fusion of the individual insulating elements, is conceivable here. Particularly advantageous is an interconnection of the insulating elements by means of a carrier element. Said carrier element may be arranged with its entire circumference inside the upper part and/or the cover. Furthermore, the insulating element may be provided on and/or against the carrier element. The insulating elements and the carrier element may be made of the same material and/or be injection-molded against the upper part and/or the cover. All characterizing features and details of the insulating element as regards the positioning, construction, and material thereof then also hold for the carrier element. The carrier element makes a further contribution towards preventing high-voltage breakdowns arising from the high-voltage connection.

It is particularly advantageous when the insulating element is arranged in a channel of the labyrinth that extends in the closing direction of the cover. When the insulating element is placed in a channel of the labyrinth that extends in the closing direction of the cover, a force arising from the deformation of the insulating element will be active so as to retain the cover on the upper part.

It may be useful, furthermore, to prolong the labyrinth path by means of defined designs of the cover and the upper part. For this purpose the upper part may comprise a first collar element that surrounds the opening at the circumference thereof. In a further embodiment it may be provided that a lamp cap element is arranged inside the opening, which element extends inside the opening in a direction opposed to the closing direction of the cover. The connection carrying a high voltage may extend at the free end of the lamp cap element.

It is furthermore conceivable that a closing element corresponding with the opening is present at the cover. The cover may furthermore comprise a second collar element. It may be effective if the second collar element annularly surrounds the closing element. In an end position of the cover and the upper part, the second collar element and the closing element may be enclosed by the first collar element, or alternatively the first collar element may interpose itself between the second collar element and the closing element. It may be useful here if the shape of the first collar element corresponds to the shape of the second collar element and/or the closing element.

Further advantages, characteristics, and details of the invention will become apparent from the ensuing description in which several embodiments of the invention are discussed in detail with reference to the drawings. The characterizing features mentioned in the claims and the description may each be essential for the invention either singularly or in any combination.

Figure 2:
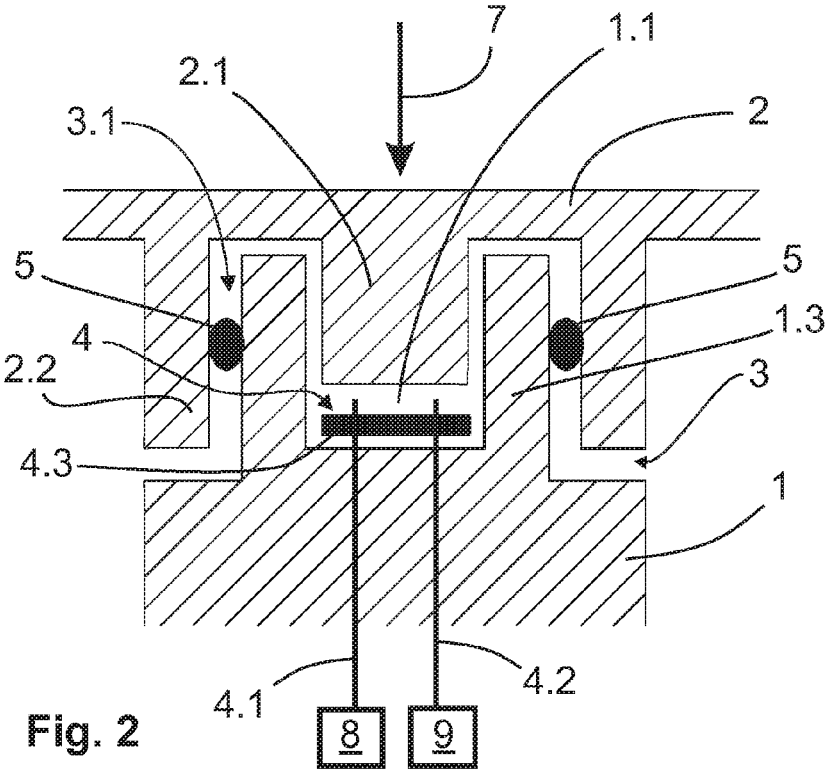
Figure 3:
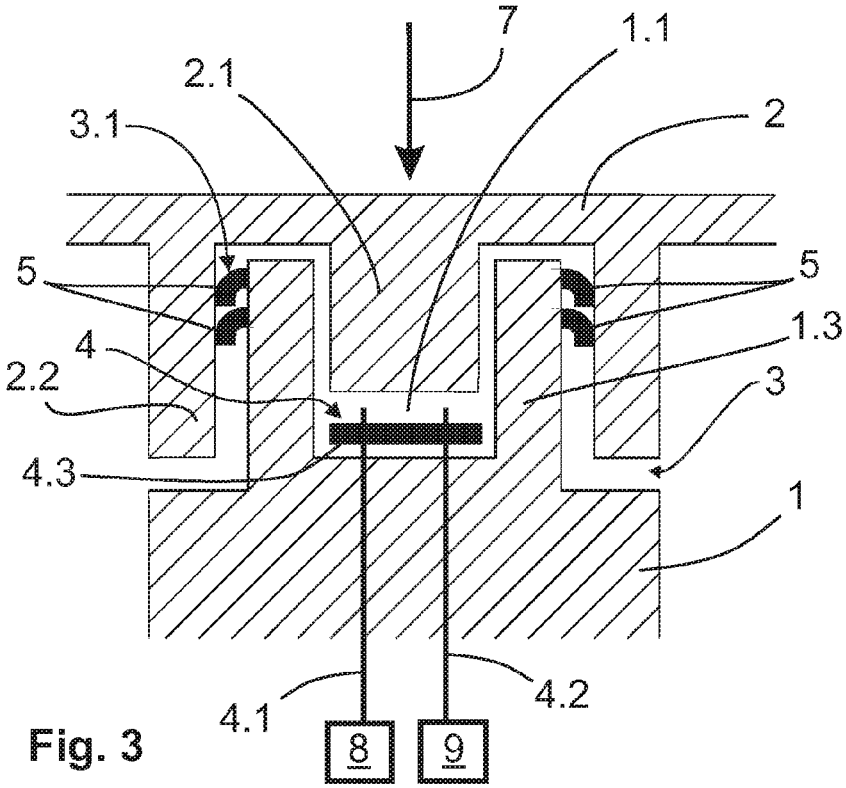
Figure 4:
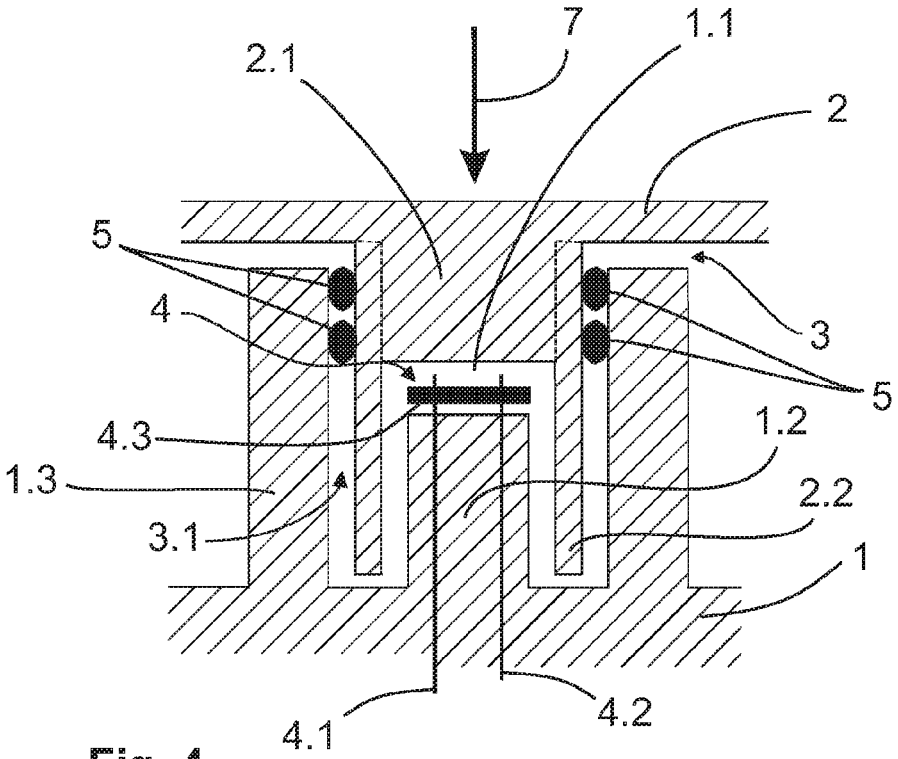
Figure 5:
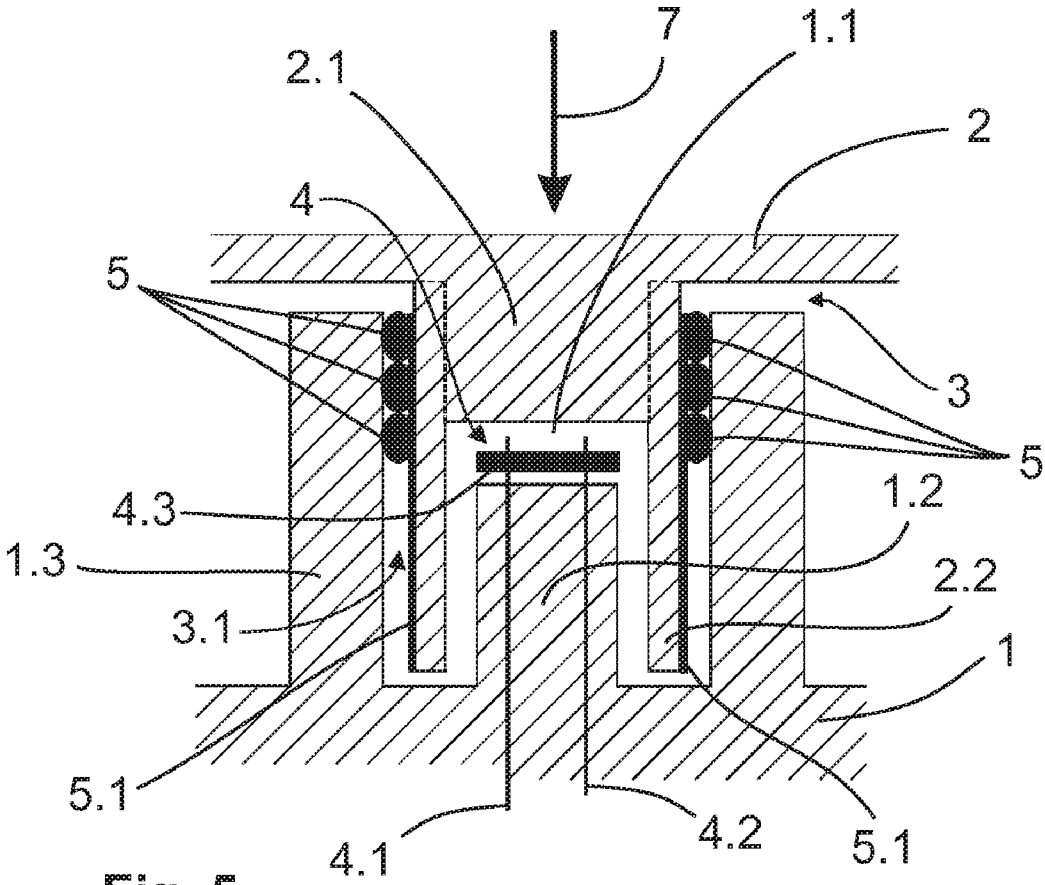

In the drawing:

FIG. 1 is a cross-sectional view of a high-pressure gas discharge lamp according to the invention, FIG. 2 is a cross-sectional view of a second embodiment of the high-pressure gas discharge lamp according to the invention, FIG. 3 is a cross-sectional view of a third embodiment of the high-pressure gas discharge lamp according to the invention, FIG. 4 is a cross-sectional view of a fourth embodiment of the high-pressure gas discharge lamp according to the invention, FIG. 5 is a cross-sectional view of a fifth embodiment of the high-pressure gas discharge lamp according to the invention.

A high-pressure gas discharge lamp 8 shown in FIG. 1 comprises a lamp cap housing 1, 2 with an upper part 1 and a cover 2. The upper part 1 has an opening 1.1 within which a connection 4 carrying a high voltage is held. The high-voltage connection 4 held within the opening 1.1 achieves a connection between a first contact 4.1 and a second contact 4.2 via a contact bridge 4.3. In this embodiment, the high-pressure gas discharge lamp 8 is connected by its first contact 4.1 via the contact bridge 4.3 to the second contact 4.2, the latter then establishing the connection to an electronic ignition system 9 that is present inside the upper part 1 of the lamp cap housing 1, 2. The high-voltage connection 4 is arranged at the side of the opening 1.1 that is remote from the cover 2.

A closing element 2.1 arranged at the cover 2 is held in the opening 1.1 in the closing direction 7 of the cover 2. The free space between the mutually opposed sides of the cover 2 and the upper part 1 here defines a labyrinth 3. An insulating element 5 is provided within a channel 3.1 of the labyrinth 3, said channel extending in the closing direction 7 of the cover 2. The upper part 1 has a groove 6 in which the insulating element 5 is retained. The high voltages of the high-voltage connection 4 between the upper part 1 and the cover 2 are effectively screened off by the insulating element 5 arranged inside the labyrinth 3.

FIG. 2 shows a further embodiment of a high-pressure gas discharge lamp 8 with an upper part 1 and a cover 2. Both the closing element 2.1 and a second collar element 2.2 are arranged at the cover 2. The second collar element 2.2, which is located at a distance from the closing element 2.1, surrounds the closing element 2.1. The first collar element 1.3 that is provided at the upper part 1 extends in a direction opposed to the closing direction 7 in the intervening space formed between the closing element 2.1 and the second collar element 2.2. The labyrinth 3 here has two channels 3.1 extending in the closing direction 7. The insulating element 5 is accommodated in the channel 3.1 in contact with the first collar element 1.3 and the second collar element 2.2. The geometrical arrangement of the cover 2 and the upper part 1 as described here makes the labyrinth longer as compared with the embodiment of FIG. 1, which improves the high-voltage protected situation of the high-voltage connection.

FIG. 3 shows a further embodiment of a high-pressure gas discharge lamp 8 with an upper part 1 and a cover 2, wherein a connection 4 carrying a high voltage is held in place within the opening 1.1 in a high-voltage protected manner in a labyrinth 3. Two insulating elements 5 are injection-molded herein against that side of the first collar element 1.3 that faces the second collar element 2.2. During assembly the insulating element 5 and the upper part 1 form a single component. Furthermore, the insulating elements 5 are shaped as lamellae and exert a force on the cover 2 and the upper part 1 after the cover 2 has been inserted into the opening 1.1 in the closing direction 7, such that the cover 2 is reliably retained in the upper part 1.

FIG. 4 is a detailed view of a further modification of the high-pressure gas discharge lamp 8 with an upper part 1 and a cover 2, wherein the connection 4 carrying a high voltage is held in place within the opening 1.1 on a lamp cap element 1.2. The lamp cap element 1.2 extends away from the upper part 1 in a direction opposed to the closing direction 7. Both the closing element 2.1 and the second collar element 2.2 project into the opening 1.1 and surround the high-voltage connection 4. A first collar element 3.1 is arranged at the upper part 1 so as to surround the second collar element 2.2 circumferentially in the assembled state of the cover 2 and the upper part 1. Two insulating elements 5 are located within the channel 3.1 of the labyrinth 3, which channel 3.1 extends in the closing direction 7, so as to bear on the first collar element 1.3 and the second collar element 2.2.

In the further modification of the high-pressure gas discharge lamp 8 according to the invention shown in FIG. 5, wherein the upper part 1 and the cover 2 are shown in the assembled state, three insulating elements 5 interconnected by a common carrier element 5.1 are provided in the channel 3.1 that extends in the closing direction 7. The carrier element 5.1 lies with matching shape against that side of the second collar element 2.2 that faces the first collar element 1.3. The insulating properties of the second collar element 2.2 are enhanced thereby so as to avoid a high-voltage breakdown across the second collar element 2.2. The insulating elements 5 and the carrier element 5.1 are made of the same material here, which means that the insulating elements 5 and the carrier element 5.1 are injection-molded to the cover 2 in one process step. It would be conceivable, in a further modification, to provide the insulating element 5 and the carrier element 5.1 against the lamp cap housing 1, 2 in a 2K injection molding process.

LIST OF REFERENCE NUMERALS

1 upper part
1.1 opening
1.2 lamp cap element
1.3 first collar element
2 cover
2.1 closing element
2.2 second collar element
3 labyrinth
3.1 channel
4 connection carrying a high voltage
4.1 first contact
4.2 second contact
4.3 contact bridge
5 insulating element
5.1 carrier element
6 groove

7 closing direction
8 high-pressure gas discharge lamp
9 electronic ignition system

The invention claimed is:

1. A high-pressure gas discharge lamp for a lighting device, comprising an electronic ignition system arranged inside a lamp cap housing having an upper part and a cover, wherein said upper part is provided with an opening within which a connection (4) carrying a high voltage between the high-pressure gas discharge lamp and the electronic ignition system (9) is present, the cover projects into said opening and closes off this opening in an insulating manner, and the mutually facing surfaces of the upper part and the cover form a labyrinth that is interrupted by an insulating element.

2. A high-pressure gas discharge lamp as claimed in claim 1, wherein the insulating element forms a circumferentially closed ring.

3. A high-pressure gas discharge lamp as claimed in claim 1, wherein the insulating element has at least one of the following diametrical shapes: polygonal, round, or oval.

4. A high-pressure gas discharge lamp as claimed in claim 1, wherein the insulating element is constructed as an elastic sealing ring.

5. A high-pressure gas discharge lamp as claimed in claim 1, wherein the insulating element is injection-molded against the upper part and/or against the cover.

6. A high-pressure gas discharge lamp as claimed in claim 1, wherein the upper part and/or the cover is/are provided with a groove inside the labyrinth, in which groove the insulating element is detachably fastened.

7. A high-pressure gas discharge lamp as claimed in claim 1, wherein the contour of the insulating element has a lamellae shape, generating a force that retains the cover on the upper part.

8. A high-pressure as discharge lamp as claimed in claim 1, wherein the insulating element exerts a force inside the labyrinth both on the cover and on the upper part.

9. A high-pressure gas discharge lamp as claimed in claim 1, wherein the insulating element has a diameter in cross-section of $0.5\ \text{mm} \leqq x \leqq 4\ \text{mm}$.

10. A high-pressure gas discharge lamp as claimed in claim 1, wherein at least two insulating elements are interconnected and arranged inside the labyrinth.

11. A high-pressure gas discharge lamp as claimed in claim 1, wherein the insulating element is arranged in a channel of the labyrinth that extends in the closing direction (7) of the cover.

12. A high-pressure gas discharge lamp as claimed in claim 1, wherein the upper part comprises a first collar element that circumferentially surrounds the opening.

13. A high-pressure gas discharge lamp as claimed in claim 1, wherein a lamp cap element provided on the upper part is arranged inside the opening.

14. A high-pressure gas discharge lamp as claimed in claim 1, further comprising a closing element corresponding with the opening disposed at the cover.

15. A high-pressure gas discharge lamp as claimed in claim 1, wherein the cover comprises a second collar element which extends between the lamp cap element and the first collar element.

* * * * *